US008382424B1

(12) United States Patent
Liang

(10) Patent No.: US 8,382,424 B1
(45) Date of Patent: Feb. 26, 2013

(54) TURBINE VANE MATE FACE SEAL PIN WITH IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 519 days.

(21) Appl. No.: 12/782,118

(22) Filed: May 18, 2010

(51) Int. Cl.
*F01D 11/00* (2006.01)

(52) U.S. Cl. ..... 415/115; 277/644

(58) Field of Classification Search ..... 416/193 A, 416/221
See application file for complete search history.

(56) References Cited

U.S. PATENT DOCUMENTS 4,767,260 A * 8/1988 Clevenger et al. ..... 415/115
5,167,485 A * 12/1992 Starkweather ..... 415/115
7,217,081 B2 * 5/2007 Scheurlen et al. ..... 415/1

* cited by examiner

*Primary Examiner* — Nathaniel Wiehe
*Assistant Examiner* — Jeffrey A Brownson
(74) *Attorney, Agent, or Firm* — John Ryznic

(57) ABSTRACT

A stator vane with an endwall having a mate face with a seal slot, where the seal slot includes a row of feed slots on an outer side and two rows of impingement slots on an inner side and along the sides of the seal pin. Each impingement slot is connected by an impingement hole to one of the feed slots. With the seal pin secured within mate face seal slots of adjacent endwalls, cooling air flows through the feed holes and through the impingement holes to provide convection and impingement cooling for the mate faces. The spent impingement cooling air then flows out the diffusion slots and into the gap to purge hot gas flow away from the gap.

10 Claims, 5 Drawing Sheets

TURBINE VANE MATE FACE SEAL PIN WITH IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane with an endwall mate face seal and cooling design.

2. Description of the Related Art Including Information Disclosed Under 37 CFR 1.97 and 1.98

A gas turbine engine includes a turbine having one or more stages or rows of stator vanes and rotor blades in which a hot gas flow is passed through the convert the energy from the hot gas flow into mechanical work to drive a compressor and, in the case of an industrial gas turbine (IGT) engine, an electric generator. The first stage stator vane is exposed to the highest gas flow temperature, since the first stage is exposed to the gas flow directly from the combustor outlet.

The efficiency of the engine can be increased by passing a higher temperature gas flow into the turbine. However, the turbine inlet temperature is limited to the material properties of the turbine and an amount of cooling used in the airfoils, especially the first stage airfoils. Not only is adequate cooling required, but certain areas of the airfoils and platforms or endwalls must be kept below specific metal temperatures so that erosion damage will not occur. The hot gas flow is not at a consistent temperature throughout. Also, the hot gas flow can migrate to areas around the airfoils and into cavities outside of the normal hot gas flow path. These instances can create hot spots on certain sections of the blades or vanes. Hot spots will cause erosion damage in which the metal material will erode away and leave the surface weakened or open a hole in which the hot gas can ingest into the inside passages within the airfoil.

In a stator vane as seen in FIG. 1, the airfoil extends between an inner endwall and an outer endwall. A bow wave driven hot gas flow ingestion affect is created when the hot gas core flow entering the vane row where the leading edge of the vane induces a local blockage and therefore creates a circumferential pressure variation at an intersection of the airfoil leading edge location. The leading edge of the turbine vane generates an upstream pressure variation which can lead to hot gas ingress into a front gap (see the curved arrow in the leading edge of the inner endwall in FIG. 1). A high pressure ahead of the vane leading edge is greater than the pressure inside the cavity formed below the inner endwall. This leads to radial inward flow of the hot gas into the cavity. The ingested hot gas flows through a gap between adjacent endwalls circumferentially inside the cavity towards a lower pressure zone, and finally outflow of the hot gas at the points where the cavity pressure is higher than the local hot gas flow pressure. FIG. 2 shows a top view of a pair of adjacent vanes where the hot gas ingestion flows into the vane mate face gap. If proper cooling or design measures are not undertaken to prevent this hot gas ingress, the hot gas ingress can lead to severe damage to the front edge of the vane endwall as well as the sealing material or mate face in-between the vane endwalls of adjacent vanes.

In general, the size of the bow wave is a strong function of the vane leading edge diameter and distance of the vane leading edge to the endwall edge. The pressure variation in the tangential direction with the gap is sinusoidal. The amount of hot gas penetrating the axial gap increases linearly with the increasing axial gap width. It is therefore important to reduce the axial gap width to a minimum allowable by tolerance limits in order to reduce the hot gas ingress.

FIG. 3 shows a prior art turbine stator vane with a cooling circuit for the lower endwall. Two adjacent vanes are shown. Cooling air flows into two inlet passages 11 in a direction toward the leading edge of the endwall, and then flows along cooling chambers 12 formed along the leading edge of the two endwalls and toward the sides where the vane endwall mate faces are formed. The cooling air then flows along a mate face cooling channel 13 toward the trailing edge of the endwalls, and then out through exit holes 15 along the trailing edge endwall. A row of cooling air exit holes 16 extend between the mate face cooling channel exit holes 15 and is supplied with cooling air from below the vane endwall. The FIG. 3 design does not prevent the hot gas ingress described above or provide adequate cooling for the endwall surfaces adjacent to the mate face that is exposed to the hot gas flow.

BRIEF SUMMARY OF THE INVENTION

The high heat transfer coefficient and high gas temperature region caused by the bow wave ingress hot gas flow problem discussed above can be alleviated by incorporating a new and innovative mate face metering and impingement cooling seal with a diffusion slot design into the airfoil leading edge section design. A submerged metering and impingement diffusion cooling design with a high temperature material mate face sealing material is formed along the forward section of the airfoil leading edge root section. The submerged metering and impingement diffusion slots are located on the airfoil leading edge region to provide for a mate face backside impingement cooling and to purge any ingression of the hot gas flow.

Multiple metering and impingement diffusion slots are used at the vane endwall leading edge corner. Cooling air is supplied from the endwall cavity and metered through the impingement cooling holes and into the diffusion slots spaced between the seal pin and an upper surface of the mate face slot in each endwall. This design generates a diffusion flow within the seal pin spacing. The multiple impingement and diffusion cooling forms a cushion of air for the mate face gap that shields off the hot gas from the vane component. A majority of the spent cooling air is discharged into the vane mate face gap in front of the vane airfoil leading edge to provide additional film cooling for the endwall cooling as well as to dilute the incoming hot gas flow. The multiple impingement hole and diffusion slot also provides for convection cooling of the vane mate face edges. The combination of convection cooling with spent air discharged into the mate face gap will lower the heat load level of the endwall edge and the metal temperature for the vane endwall. The use of individual metering and impingement diffusion slots in the mate face cooling design that forms the mate face seal slot into multiple diffusion cooling zones will minimize the pressure gradient effect for the cooling flow mal-distribution.

DETAILED DESCRIPTION OF THE INVENTION

Figure 1:
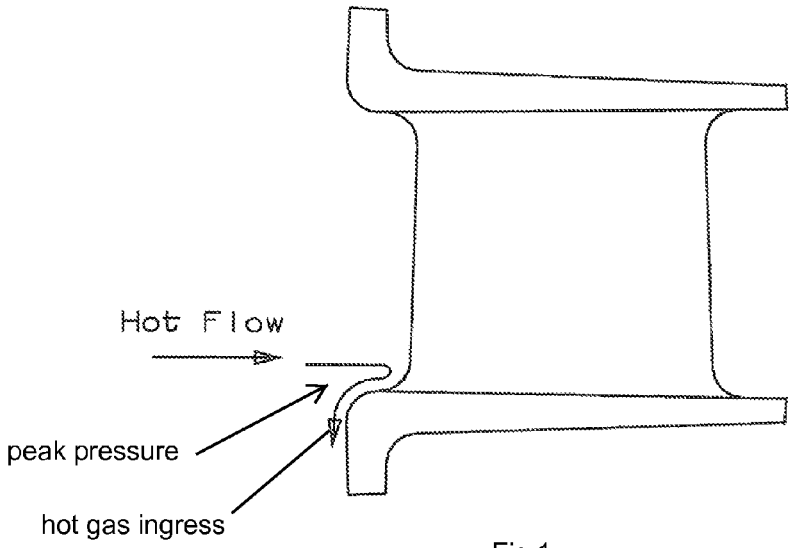
Fig 1 Prior Art
FIG. 1 shows a side view of the prior art turbine vane with the hot gas ingress flow.
Figure 2:
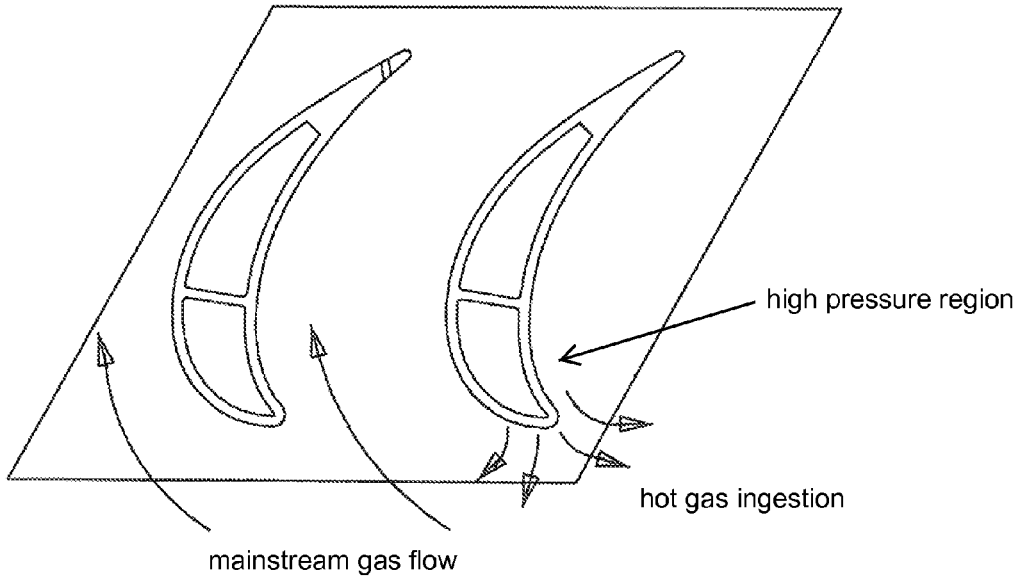
Fig 2 Prior Art
FIG. 2 shows a top view of two adjacent turbine vanes of FIG. 1 and the hot gas ingress flow.
Figure 3:
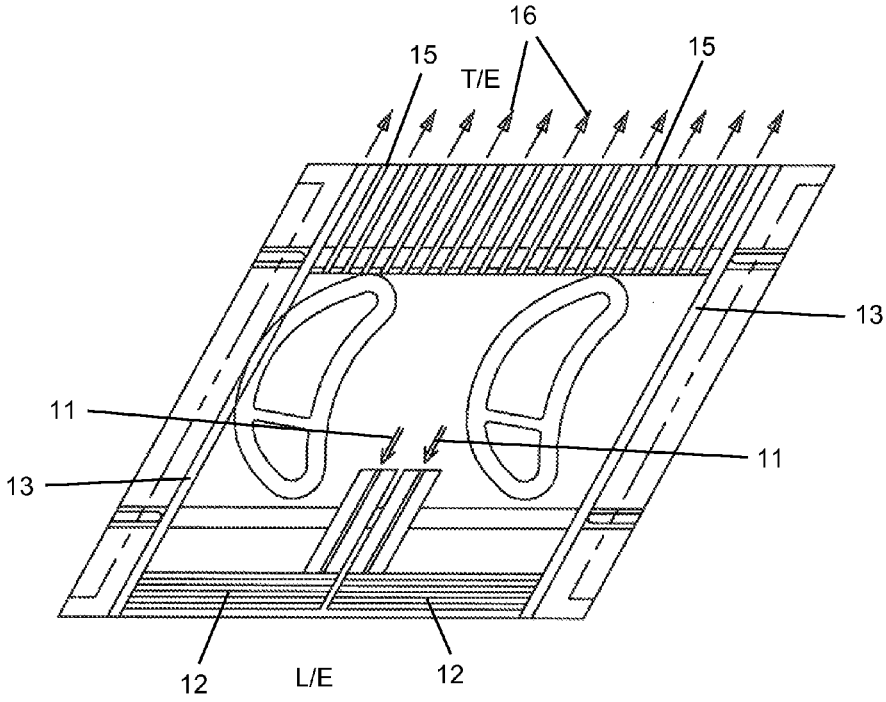
Fig 3 Prior Art
FIG. 3 shows a prior art turbine vane with endwall cooling circuit.
Figure 4:
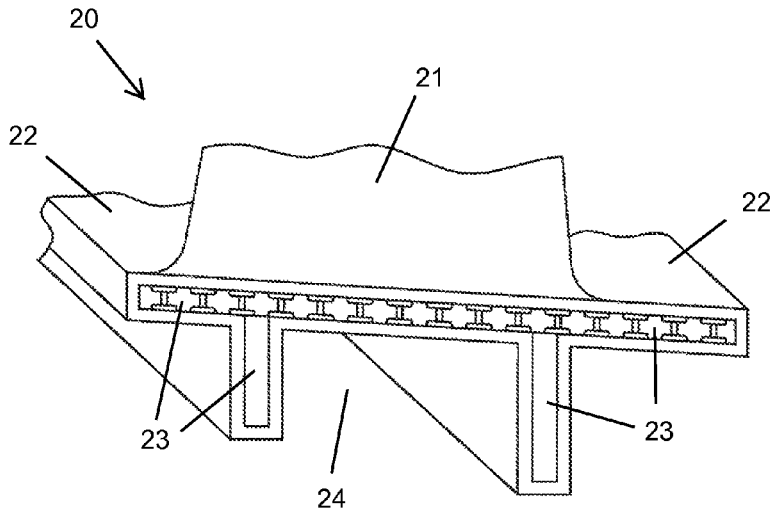
FIG. 4 shows a cross section view of a vane endwall mate face seal design of the present invention.
Figure 5:
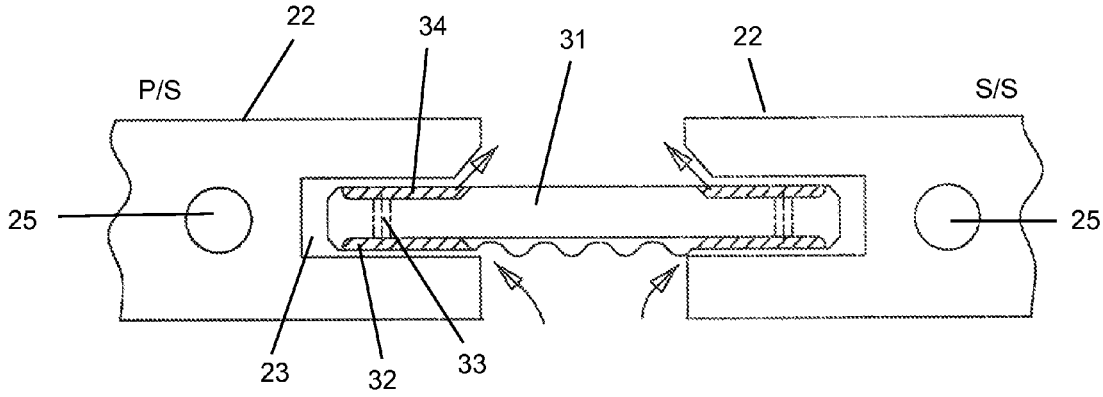
FIG. 5 shows a cross section view of the mate face seal pin within slots of two adjacent vane endwall in detail of the present invention.

The stator vane with the endwall cooling circuit of the present invention is shown in FIGS. 4-7 where in FIG. 4 the mate face side of the vane and the endwall is shown. The vane 20 includes an airfoil 21 extending from the endwalls 22 (only the inner endwall is shown) with the seal pin slots 23 opening onto the mate face surface. The slots are used with one in the axial direction and two along the radial direction (legs) in which seal pins are placed to provide for a seal between the gap that results between two adjacent vane segments. A cooling air supply cavity 24 is formed below the endwall 22 and between adjacent radial legs of the vane. A seal pin 31 is inserted into the axial slot and includes a number of supply slots on the bottom, a number of diffusion slots on the top and a number of impingement holes connecting each of the supply slots to a diffusion slot. FIG. 5 shows this structure in more detail.

In FIG. 5, two adjacent endwalls 22 are shown each having a slot 23 opening onto the mate face. The left endwall 22 is the pressure side (P/S) and the right endwall 22 is the suction side (S/S). Each endwall 22 includes a mate face cooling air channel 25. The mate face cooling air channel 25 is too far away from the mate face to provide adequate cooling. The mate faces tend to over-heat and lead to erosion that causes short part life. A seal pin 31 is secured within the two opposed slots 23 to form a seal in the gap between the hot gas stream. The seal pin 31 includes a series of local cooling air feed slots 32 on the bottom side of the seal pin that extend from one side to the opposite side. The seal pin 31 also includes a series of diffusion slots 34 on the top side that extend along both sides from the front to the back end of the seal pin 31. Each of the diffusion slots 34 is connected to a feed slot 32 by an impingement hole 33. Both the feed slots 32 and the diffusion slots 34 extend into the gap so that the cooling air from the bottom of the seal pin can flow into the feed slots 32, through the impingement holes 33, into the diffusion slots 34 and then out into the gap but on the top side of the seal pin 31.

Figure 6:
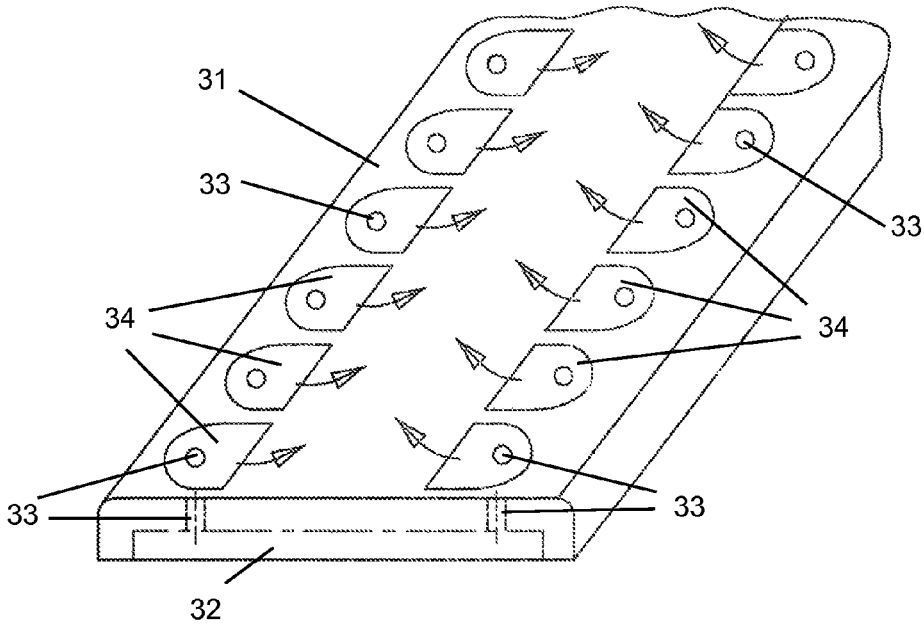
FIG. 6 shows an isometric view from the top and side of the seal pin of the present invention.
Figure 7:
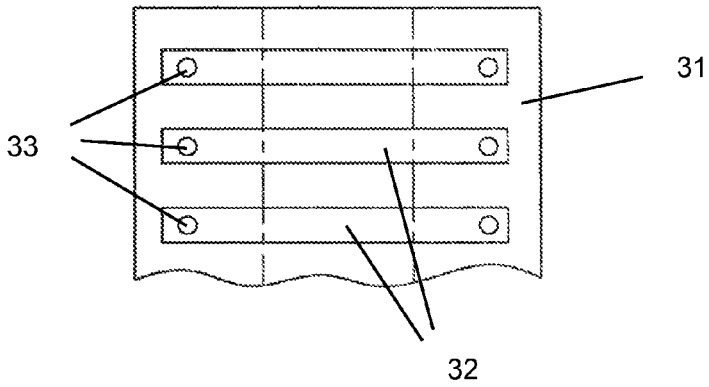
FIG. 7 shows a bottom view of the seal pin of the present invention.

FIG. 6 shows an isometric view of the seal pin 31 with the two rows of diffusion slots 34 that open onto the left side and the right side of the seal pin 31. The diffusion slots 34 extend the axial length of the seal pin 31 from the front end to the back end. The series of feed slots 32 on the bottom side of the seal pin extend from the left side to the right side. Each of the diffusion slots 34 is connected by an impingement hole 33 to a feed slot 32 located below the diffusion slot 34. FIG. 7 shows a bottom view of a section of the seal pin 31 with the feed slots 32 extending from one side to the opposite side and with an impingement hole 33 for each side of the feed slot 32. The dashed lines in FIG. 7 represent the edges of the mate face slots. Both the feed slots 32 and the diffusion slots 34 must extend past the mate face slot edges in order that the cooling air can flow into the feed slots 32 and out from the diffusion slots 34.

Each of the outer diameter and inner diameter endwalls of the vane has a seal slot in the mate faces that will receive one of the seal pins of the present invention. The top surface of each seal pin 31 that has the diffusion slots 34 will face the hot gas stream side of the endwalls. The seal pins therefore have an outer side (outer from the hot gas stream side) that has the feed slots and an inner side that has the diffusion slots.

In operation, cooling air from below the seal pin 31 will flow into the feed slots 32 to provide convection cooling for the lower or outer sides of the endwalls. The cooling air then flows into the impingement holes 33 to provide impingement cooling against the surface of the seal slots 23. The spent impingement cooling air is then diffused in the diffusion slots 34, and then flows out from the diffusion slots 34 and into the hot gas side of the gap between adjacent mate faces to purge the hot gas stream out from the gap. The cooling air circuit through the seal pin 31 provides convection and impingement cooling for the mate faces to prevent high metal temperature that results in erosion and shortened part life.

I claim the following:

1. A turbine stator vane comprising:

an endwall with a mate face;

a seal slot opening onto a mate face surface;

a seal pin secured within the seal slot;

the seal pin having an outer side with a row of feed slots extending from one side to the opposite side of the seal pin;

the seal pin having an inner side with a row of diffusion slots extending along both sides of the seal pin; and, each diffusion slot being connected to a feed slot by an impingement hole.

2. The turbine stator vane of claim 1, and further comprising:

the diffusion slots are located mostly within the seal slot of the mate face and the impingement holes are located within the seal slots such that impingement cooling of the seal slot occurs.

3. The turbine stator vane of claim 1, and further comprising:

the diffusion slots and the feed slots both extend beyond an edge of the seal slot and into a gap formed between adjacent vane endwalls.

4. The turbine stator vane of claim 1, and further comprising:

the feed slots and the diffusion slots extend from a front end to a back end of the seal pin.

5. The turbine stator vane of claim 1, and further comprising:

each of the diffusion slots is connected to a separate feed slot through one impingement hole.

6. The turbine stator vane of claim 1, and further comprising:

each feed slot is connected to two diffusion slots through two impingement holes.

7. A seal pin for a seal slot formed in a mate face of an endwall of a turbine stator vane, the seal pin comprising:

a top side and a bottom side;

a row of feed slots on the bottom side, each feed slot extending from one side of the seal pin to the opposite side;

a first row of diffusion slots extending along one side of the top side of the seal pin;

a second row of diffusion slots extending along the opposite side of the top side of the seal pin; and, each of the diffusion slots is connected to a feed slot through an impingement hole.

8. The seal pin of claim 7, and further comprising:

the impingement slots extend toward a center of the seal pin just past a location where an edge of the mate face surface would end.

9. The seal pin of claim 7, and further comprising:

each of the diffusion slots is connected to a separate feed slot through one impingement hole.

10. The seal pin of claim 7, and further comprising:

the impingement holes are located on the seal pin such that impingement cooling of the seal slot will occur.

* * * * *